United States Patent [19]

Schwarz et al.

[11] Patent Number: 4,951,929

[45] Date of Patent: Aug. 28, 1990

[54] REFRACTORY ASSEMBLY INCLUDING INNER AND OUTER REFRACTORY MEMBERS WITH INTERFERENCE SHRINK FIT THEREBETWEEN AND METHOD OF FORMATION THEREOF

[75] Inventors: Hans-Georg Schwarz; Vinay Shah; Bernhard Schiefer, all of Cincinnati, Ohio

[73] Assignee: Didier-Taylor Refractories Corporation, Cincinnati, Ohio

[21] Appl. No.: 334,861

[22] Filed: Apr. 6, 1989

[51] Int. Cl.[5] ..... B22D 41/54

[52] U.S. Cl. ..... 266/286; 222/590; 222/591; 222/600; 428/34.6

[58] Field of Search ..... 266/236, 286, 280, 45; 222/590, 591, 597; 428/34.9, 34.6; 264/342 R, 343, 345

[56] References Cited

U.S. PATENT DOCUMENTS 3,456,690 7/1969 Weed ..... 266/236

4,660,808 4/1987 Daussan et al. ..... 266/236

FOREIGN PATENT DOCUMENTS 0027432 6/1983 Japan ..... 428/34.6

*Primary Examiner*—S. Kastler

*Attorney, Agent, or Firm*—Wenderoth, Lind & Ponack

[57] ABSTRACT

A refractory assembly includes a refractory outer member having therein an opening defined by an inner surface and a refractory inner member having an outer surface. The dimension of the outer surface of the inner member is greater than the dimension of the inner surface of the outer member by an amount of from 0.05 to 0.15 mm. The outer member is heated to at least 1000° C. to thereby increase the dimension of the inner surface. The inner member then is inserted into the opening in the outer member, and the outer member then is cooled to room temperature. As a result, the inner surface of the outer member shrinks against the outer surface of the inner member to thereby form an interference shrink fit joint between the members.

19 Claims, 1 Drawing Sheet

REFRACTORY ASSEMBLY INCLUDING INNER AND OUTER REFRACTORY MEMBERS WITH INTERFERENCE SHRINK FIT THEREBETWEEN AND METHOD OF FORMATION THEREOF

BACKGROUND OF THE INVENTION

The present invention relates to a refractory or ceramic assembly including outer and inner refractory or ceramic members, the outer member having therein a cavity or opening within which is inserted the inner member. More particularly, the present invention is directed to such a refractory assembly wherein there is formed an interference shrink fit between an inner surface of the outer member and an outer surface of the inner member, thereby forming a mortarless joint between the two members.

It is known to form various refractory assemblies of the type wherein an inner refractory member is positioned within an opening in an outer refractory member. This type of assembly is common, for example, in the various wear parts of sliding gates or sliding closure units employed on metallurgical vessels, for example in the stationary and movable plates thereof, inlet and outlet nozzle bricks thereof, discharge spouts thereof, as well as refractory members for the introduction of various media into molten metal within the metallurgical vessel, as well as on various types of ceramic heat exchanger members, for example recuperators. In the past, the joint between such outer and inner refractory members has been formed by a refractory mortar, cement, etc.

However, this type of prior art joint always creates a weak point of the refractory assembly. This often leads to the joint failing and allowing destructive molten metal breakthrough. This can be caused due to eddies operating on such joint and due to the pressure and erosive capabilities of the molten metal flow. Such disadvantage results in undesirable operational uncertainties and often requires replacement of the various elements earlier than otherwise would be necessary. Additionally, the durability of such prior art joints is not satisfactory with regard to stresses due to high temperature variations. At any rate, in the prior art it normally is necessary to attempt to precisely adapt the particular joint material to be used to the stress to be expected in a given installation. Furthermore, it also is necessary to ensure that the joints are formed by a relative attentive manual joining operation, and this of course involves increased costs.

SUMMARY OF THE INVENTION

With the above discussion in mind, it is an object of the present invention to provide a refractory assembly of the type discussed above as well as a method for the formation thereof, but whereby it is possible to overcome the above and other prior art disadvantages.

It is a more specific object of the present invention to provide such, an assembly and method for formation thereof whereby the joint between the inner and outer refractory members is substantially strengthened, both with regard to durability of the joint and operational safety thereof.

The above objects are achieved in accordance with the present invention by the provision that the inner member is positioned within the opening in the outer member with an interference shrink fit between the inner surface of the outer member and the outer surface of the inner member, thereby forming a joint between the members. In this manner, a mortarless joint or connection is created that, from the beginning, ensures greater operational safety and durability. Furthermore, by relatively adjusting the intensity of the shrink fit between the surfaces of the two members it is possible to provide, for a given assembly, a particularly high degree of resistance of the joint to temperature changes. Accordingly, even with relatively high thermal stress, the joint will remain resistant to infiltration of the molten metal.

Depending upon the particular application of the concepts of the present invention, the inner and outer surfaces forming the joint may be circular in transverse cross section, and particularly the inner member may be tubular with a passage therethrough. The tubular inner member can have a uniform wall thickness. The inner and outer surfaces may be cylindrical, and it thereby is possible to achieve an even degree of shrinkage throughout the entire joint. In some assemblies it may be equally advantageous to provide that the outer surface of the tubular inner member and the inner surface of the outer member are of conically tapered configuration. This can ensure that the joint is formed in a form fitting and force fitting manner and eliminates dimensional problems or adherence to precise tolerances of the shrink fit. In this arrangement, any excessive length portion of the tubular inner member simply can be removed after shrinking the outer member into place about the inner member. The passage through the tubular inner member also can have a conical configuration to ensure an even wall thickness throughout the tubular inner member. In certain applications it may be advantageous to provide that the inner and outer surfaces are of a conically tapered configuration for a first length portion of the joint and are of a cylindrical configuration for a second length portion of the joint. Preferably the cylindrical second length portion is at least two thirds longer than the conical first length portion. In all situations it is possible to provide the tubular inner member with a longitudinal or inclined slit, thereby, for example, compensating for radial heat tension stress or, with a low internal stress, to accommodate any potential fitting problems due to tolerance variations between the dimensions of the inner and outer surfaces.

In accordance with a further feature of the present invention, it may be desirable to form the outer member of a refractory material based on alumina. The inner member also may be formed of a refractory material based on alumina, thereby providing favorable shrink fit properties. However, it also is possible to form the inner member of a highly wear-resistant refractory material, such as zirconium oxide. This is advantageous when the molten metal is relativelY highly abrasive, corrosive or erosive. Additionally however, it is possible to form the inner member of a relatively wearable refractory material such as chamotte or fire clay. This might be advantageous in situations where it actually is desired to provide a progressive wearing away of the inner member.

The shrink fit according to the present invention particularly is achieved by providing that the outer surface of the inner member has a dimension greater than the dimension of the inner surface of the outer member. For example, the diameter of the outer surface of a tubular inner member may be greater by an amount of from 0.05 to 0.15 mm than the diameter of the inner surface of the outer member. The outer member is heated to a temperature of at least 1000° C., thereby increasing the dimension of the inner surface of the outer member. The cold, i.e. unheated, inner member is inserted into the opening in the outer member, and then the outer member is cooled, for example to substantially room temperature. During such cooling the outer member shrinks and specifically the inner surface of the outer member shrinks against the outer surface of the inner member to form an interference shrink fit therebetween. The heating of the outer member preferably is carried out at a rate of temperature increase of approximately 100° C. per hour. These procedural operations however are variable and must be adapted to the particular fireproof refractory materials employed. The particular refractory materials involved should have properties, for example expansion and contraction properties, largely similar to those of alumina-based refractory materials. However, one of ordinary skill in the art, given the present disclosure, readily would be able to develop a particular assembly for a given use and environment.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
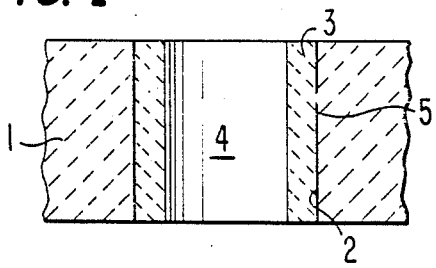
FIGS. 1–3 are cross-sectional views illustrating various configurations of joints produced in accordance with the present invention.
Figure 2:
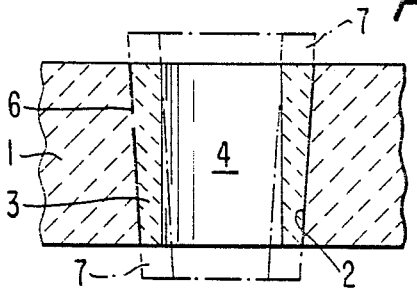
Figure 3:
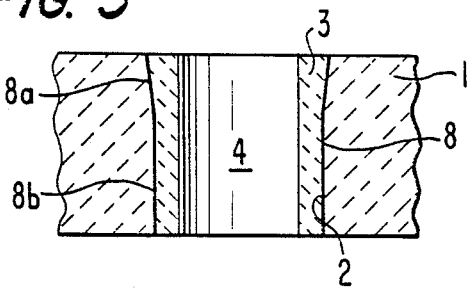

Each of FIGS. 1–3 shows an outer refractory member 1 having therethrough a cavity or opening 2 defined by an inner surface. A tubular refractory inner member 3 is within opening 2 and has an outer surface. In each case the fit between the inner and outer surfaces is an interference fit resulting from shrinkage of the outer member over the inner member.

More particularly, such interference shrink fit is illustrated at 5 in FIG. 1, wherein the inner and outer surfaces are of cylindrical configuration and the tubular inner member 3 has a uniform wall thickness.

In FIG. 2 the interference shrink fit is indicated at 6, and in this embodiment the inner and outer surfaces are of a conically tapering configuration. The tubular inner member 3 can have a cylindrical inner surface, as indicated by solid lines in FIG. 2, in which case the wall thickness of the tubular inner member reduces in the direction of the conical tapering of the joint. Alternatively, as shown by dashed lines in FIG. 2, the opening 4 through the tubular inner member 3 may be of conically tapered configuration, thereby making it possible to provide that the tubular inner member 3 has a uniform wall thickness. In the embodiment of FIG. 2 the shrink fit does not need to be provided at precise tolerance since, after the shrinkage operation, any end parts 7 that protrude from the outer member 1 easily can be removed, for example by cutting or grinding.

In the embodiment of FIG. 3 the joint 8 includes a first length portion 8*a* of a conically tapered configuration and a second length portion 8*b* of a cylindrical configuration. In use, the first length portion 8*a* would be at a molten metal inflow side of passage 4, and the second length portion 8*b* would be of a greater length than first length portion 8*a*, for example two-thirds longer.

Figure 4:
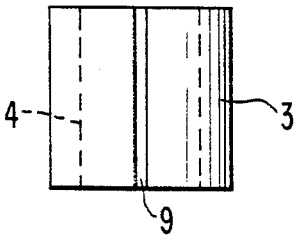
FIG. 4 is an elevation view of a tubular refractory inner member having therein a longitudinal slit.

It is to be understood that the passageway 4 through the tubular inner member can be of other configurations known in the art, for example for restricting a molten metal flow. Furthermore, as shown in FIG. 4, it is possible to provide the tubular inner member 3 with a longitudinal slit 9. This can compensate for errors or variations from shrink fit tolerances. The slit 9 furthermore could be provided in an oblique direction relative to the longitudinal axis of member 3.

The interference shrink fit joints 5, 6, 8 can be provided in any refractory assembly joining inner and outer refractory members of any type. Such joints particularly advantageously can be provided in the various wear parts of slide gates or sliding closure units for controlling the discharge of molten metal from a metallurgical vessel. This particularly applies to stationary and movable refractory plates, inflow and outflow nozzles or sleeves and reversible sleeves and plugs, as well as discharge tubes of all types. The joint of the present invention also can be employed in refractory heat exchangers, for example recuperator structures.

Figure 5:
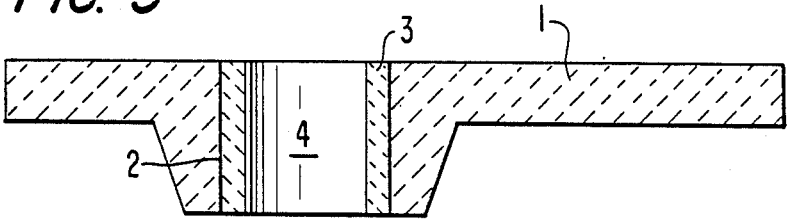
FIG. 5 is a cross-sectional view through a refractory plate of a sliding closure unit incorporating the present invention.

FIG. 5 illustrates the present invention applicable to an outer refractory part 1 in the form of a stationary or movable plate of a sliding closure unit, the plate having therethrough a discharge opening, with the discharge opening being formed by passageway 4 in a tubular insert 3 forming an inner refractory member. Plate 1 is, for example, a fired slide plate of refractory material having an alumina content of at least 60° by weight. Tubular sleeve 3 is of a highly wear-resistant statically pressed and fired refractory material having a zirconium oxide content of more than 90% by weight. With such material, the diameter of opening 2 in plate 1 is 0.1 mm smaller than the outer diameter of tubular insert 3. Plate 1 is heated to a temperature of approximately 1300° C., after which tubular insert 3 is inserted into opening 2, and plate 1 then is cooled to room temperature in a cooling chamber. The result is an interference shrink fit of plate 1 about tubular insert 3. It is to be understood that the above specific parameters are exemplary only of this embodiment.

Figure 6:
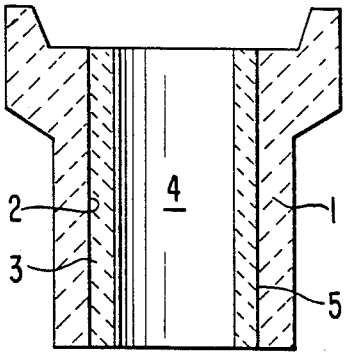
FIG. 6 is a cross-sectional view of an outlet nozzle or sleeve of a sliding closure unit and constructed according to the present invention.

FIG. 6 illustrates an outflow sleeve or nozzle 1 having therein a tubular insert 3. The above compositions and dimensions equally may be employed in this embodiment, particularly when insert 3 is intended to be exchangeable.

In either of the above embodiments, it may be desired that the outlet opening 4 be of gradually increasing size, for example to maintain a constant discharge of molten metal when the ferrostatic pressure within the metallurgical vessel gradually decreases. This can be achieved in accordance with the present invention by the formation of the tubular insert 3 of a relatively wearable refractory material, for example chamotte or fireproof clay, that gradually becomes worn away during discharge of molten metal through discharge opening 4.

The particular possible refractory materials that can be employed together for the inner and outer members, as well as the required dimensional tolerances and the degrees of heating and cooling would be obtainable by one skilled in the art.

Figure 7:
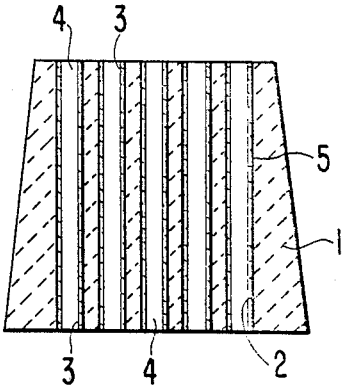
FIG. 7 is a cross-sectional view of a unit to be employed to introduce material into molten metal within a metallurgical vessel.

FIG. 7 illustrates another application of the present invention, wherein an outer refractory member 1 has therethrough a plurality of openings 2 each of which receives a tubular inner member 3. This assembly can be employed, for example, as a tuyere device wherein the orifices are employed in metallurgical vessels for the introduction of gaseous and/or solid substances into the molten metal for treatment thereof.

Figure 8:
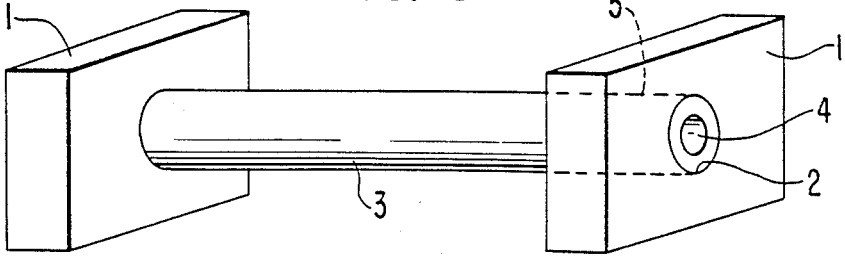
FIG. 8 is a perspective view of a heat exchanger component, for example a part of a recuperator, constructed in accordance with the present invention.

FIG. 8 illustrates a further application of the present invention, particularly in the environment of a refractory heat exchanger, for example a ceramic recuperator. Thus, outer refractory members 1 are shrink fit around opposite ends of a tubular refractory inner member 3. Outer members 1, for example, are suitable to be mounted on a recuperator wall. It of course would be understood that there would be provided a plurality of tubes 3 extending between two outer members 1. In such an arrangement, for example, hot waste gases would flow around the exterior of the tubes 3, and air would be passed through the passages 4 in the tubes.

Although the present invention has been described and illustrated with respect to preferred features thereof, it is to be understood that various changes and modifications may be made to the specifically described and illustrated features without departing from the scope of the present invention.

We claim:

1. A refractory assembly comprising:

a refractory outer member having therein an opening defined by an inner surface;

a refractory inner member having an outer surface; and said inner member being within said opening in said outer member with an interference shrink fit between said inner and outer surfaces, thereby forming a joint between said members.

2. An assembly as claimed in claim 1, wherein said joint comprises a mortarless joint.

3. An assembly as claimed in claim 1, wherein said inner and outer surfaces are circular in transverse cross section.

4. An assembly as claimed in claim 3, wherein said inner member is tubular and has a passage therethrough.

5. An assembly as claimed in claim 4, wherein said tubular inner member has therein a slit.

6. An assembly as claimed in claim 4, wherein said tubular inner member has a uniform wall thickness.

7. An assembly as claimed in claim 4, wherein said outer surface of said tubular inner member and said inner surface of said outer member are of conically tapered configuration.

8. An assembly as claimed in claim 7, wherein said tubular inner member has a uniform wall thickness.

9. An assembly as claimed in claim 1, wherein said inner and outer surfaces are of cylindrical configuration.

10. An assembly as claimed in claim 1, wherein said inner and outer surfaces are of conically tapered configuration.

11. An assembly as claimed in claim 1, wherein said inner and outer surfaces are of conically tapered configuration for a first length portion of said joint and are of cylindrical configuration for a second length portion of said joint.

12. An assembly as claimed in claim 11, wherein said second portion is at least two-thirds longer than said first length portion.

13. An assembly as claimed in claim 1, wherein said outer member is formed of an alumina-containing refractory material.

14. An assembly as claimed in claim 13, wherein said inner member is formed of an alumina-containing refractory material.

15. An assembly as claimed in claim 13, wherein said inner member is formed of a wear-resistant refractory material.

16. An assembly as claimed in claim 13, wherein said inner member is formed of a wearable refractory material.

17. A method of forming a refractory assembly with a joint between an inner surface defining an opening in an outer refractory member and an outer surface of an inner refractory member, said method comprising:

providing said outer surface of said inner member with a dimension greater than the dimension of said inner surface of said outer member by an amount of from 0.05 to 0.15 mm;

heating said outer member to at least 1000° C. and thereby increasing said dimension of said inner surface;

inserting said inner member into said opening in said outer member; and cooling said outer member to substantially room temperature and thereby shrinking said inner surface against said outer surface to form an interference shrink fit therebetween.

18. A method as claimed in claim 17, comprising heating said outer member at a rate of temperature increase of approximately 100° C. per hour.

19. A method as claimed in claim 17, comprising shrinking said inner surface against said outer surface without mortar therebetween.

* * * * *